US006526681B1

(12) United States Patent
De Saro

(10) Patent No.: US 6,526,681 B1
(45) Date of Patent: Mar. 4, 2003

(54) SIGN FOR ILLUMINATION UTILIZING TRANSLUCENT LAYERS

(76) Inventor: Javier A. G. De Saro, Levante 29, E-Cartagena, Los Dolores (ES)

( * ) Notice: Subject to any disclaimer, the term of this patent is extended or adjusted under 35 U.S.C. 154(b) by 0 days.

(21) Appl. No.: 09/647,118

(22) PCT Filed: Mar. 26, 1999

(86) PCT No.: PCT/US99/06444

§ 371 (c)(1),
(2), (4) Date: Mar. 2, 2001

(87) PCT Pub. No.: WO99/49441

PCT Pub. Date: Sep. 30, 1999

(51) Int. Cl.[7] ..... G09F 13/04
(52) U.S. Cl. ..... 40/564; 40/577; 40/615
(58) Field of Search ..... 40/564, 577, 575, 40/576, 595, 568, 427, 615; 362/812

(56) References Cited

U.S. PATENT DOCUMENTS

| | | | | |
|---|---|---|---|---|
| 276,558 | A | * | 5/1883 | Brown, Jr. |
| 478,204 | A | * | 7/1892 | McGimsey |
| 1,786,155 | A | * | 12/1930 | Farrell |
| 1,805,798 | A | * | 5/1931 | Bedrossyan |
| 1,887,523 | A | * | 11/1932 | Schenkel |
| 1,975,690 | A | * | 10/1934 | Harrington et al. |
| 1,998,857 | A | * | 4/1935 | Wolff |
| 2,058,058 | A | * | 10/1936 | Caccia |
| 2,071,239 | A | * | 2/1937 | Spencer et al. |

(List continued on next page.)

FOREIGN PATENT DOCUMENTS

| | | | |
|---|---|---|---|
| FR | 854940 | | 4/1970 |
| FR | 2404270 | | 4/1979 |
| GB | 414216 | * | 8/1934 |
| GB | 496482 | * | 11/1938 |

OTHER PUBLICATIONS

Product Bulletin "Reflexite" Reflective Material, Reflexite Corporation, Nov. 1987, 2 pages.*

Guide Specification "Reflexite" Reflective Material, Reflexite Corporation, May 1990, 1 page.*

*Primary Examiner*—D. Glenn Dayoan
*Assistant Examiner*—Lori L Coletta
(74) *Attorney, Agent, or Firm*—Andrus, Sceales, Starke & Sawall, LLP

(57) ABSTRACT

The present invention comprises a sign having multiple light translucent layers are adjacent one another with such translucent layers being broken to form in one or more areas indicia (i.e. letters, numbers, etc.) meant to be visualized by an observer. These areas include a mid-layer, which is preferably colored and may be florescent, and a forefront layer. A transparent substrate or void layer is located between the mid-layer and the forefront layer, the forefront layer being closest to the observer. The forefront layer is comprised of a base color layer, which may be reflective, and an outer color layer which is closest to the viewer. The base color layer and the outer color layer, like the mid-layer, are in the shape of letters and indicia to be communicated. At least one milky white background layer forms the back of the sign. Other milky white layers having breaks in their integrity may be located adjacent to the rear most milky white layer and resulting in a soft background design.

12 Claims, 4 Drawing Sheets

U.S. PATENT DOCUMENTS 2,107,860 A * 2/1938 Gilbert
2,155,936 A * 4/1939 Fuller
2,211,571 A * 8/1940 Jonap
2,213,868 A * 9/1940 Lucian
2,262,930 A * 11/1941 Gasper
2,285,907 A * 6/1942 Davis
2,374,323 A * 4/1945 Bihr
2,594,903 A 4/1952 Freedman et al. ..... 40/135
2,689,917 A * 9/1954 Switzer
2,707,346 A * 5/1955 Fuller, Jr.
2,810,225 A * 10/1957 Hardesty
3,131,496 A * 5/1964 Schropp
3,163,554 A * 12/1964 Gessler
3,270,201 A * 8/1966 Hardesty
3,771,245 A * 11/1973 Mabrey et al. ..... 40/367
3,978,599 A * 9/1976 Berger ..... 40/542
4,106,859 A * 8/1978 Doriquzzi et al. ..... 349/113
4,424,449 A * 1/1984 O'Brill ..... 250/461.1
4,507,888 A * 4/1985 Robinson et al. ..... 40/447
4,583,766 A * 4/1986 Wessel ..... 283/88
4,891,896 A * 1/1990 Boren ..... 40/580
4,953,067 A * 8/1990 Moore ..... 40/575
4,967,317 A * 10/1990 Plumly ..... 40/550
5,009,019 A 4/1991 Erlendsson et al. ..... 40/541
5,237,766 A * 8/1993 Mikolay ..... 40/564
5,414,947 A 5/1995 Hjaltason ..... 40/615
5,444,932 A * 8/1995 Jeroma ..... 40/564
5,536,558 A * 7/1996 Shelton ..... 40/542
5,682,697 A * 11/1997 Hjaltason ..... 40/584
5,992,068 A * 11/1999 de Saro ..... 40/564

* cited by examiner

SIGN FOR ILLUMINATION UTILIZING TRANSLUCENT LAYERS

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

This invention relates to an illuminated sign having multiple translucent layers which give depth, texture and three-dimensional effects to the sign. This novel technology is based upon the utilization of multiple translucent layers which results in varying levels of brightness once the sign is illuminated. The sign as a whole is vibrant and there is no need to either darken or shadow portions of the sign in order to highlight or give the illusion that other portions are "brighter". This results in a very pure color quality and a sign which, on the whole, is brighter and has greater light intensity. Further, these multiple layers of translucency not only determine the light intensity but also the apparent depth of the letters, indicia, communications, etc. on the sign.

Companies are constantly searching for more effective ways to advertise their products. Portions of advertisement signs such as trademarks or trade names are typically meant to be viewed first and thus create a greater impact to a potential purchaser. Other portions of the sign, such as background indicia, are meant to be more subtle. In the past, advertisers used large letter size or specialized font to attract a buyer's attention to more important areas of the sign and thus "prioritize" certain areas of the sign. The advantage of this invention is that it is able to use brightness and depth as a prioritization agent, as opposed to letter size or font. The brightness, depth and texture created by this novel sign enables the eye of the observer to prioritize information allowing the eye to read what is brightest, most striking and at the forefront of the sign rather than what is in largest print.

Not only does the prior art utilize elaborate fonts and increased physical size of the letters (or indicia) to communicate to the observer what is most important, but it also utilizes actual three dimensional signs to physically place certain communications closer to the viewer. Specifically, in order to create three-dimensional appearances, varied textures and different degrees of brightness, the prior art teaches that the sign itself must be physically three-dimensional with depressed portions and raised portions, as shown in U.S. Pat. No. 2,594,903. Conversely, the present invention utilizes a series of two-dimensional translucent layers tiered one layer over another layer in order to create a three-dimensional effect.

The essence of this new technology is using multiple translucent layers and building upon these layers so that when combined, they give an illusion of texture and dimension. These different layers of translucency give the benefit of texture in an otherwise flat, two-dimensional environment. Specifically, the mere use of multiple translucent layers creates a sign which, in its entirety, is bright and also has areas of greater intensity and attraction to the observer. The novel sign is also easier to produce than the aforementioned prior art due to the simple layering of various translucent layers in order to create a 3-D effect without physically elevating or depressing different portions of the sign. In other words, there is no need for any protrusions in relief form in order to create added dimensions. As a result, the present invention does not require complex manufacturing processes to physically raise and depress different areas of the sign which have high production costs.

Still other prior art teaches darkening or shading less important areas of a sign in order to create emphasis. Specifically, U.S. Pat. No. 5,414,947 ('947) and U.S. Pat. No. 5,009,019 ('019) utilize opaque layers on the rear of the sign plate in order to prioritize information to the observer. Specifically, the '947 and the '019 patents utilize opaque layers to create differing levels of intensity by blocking out light in areas of the sign not meant to communicate information or in areas of less important communications.

However, a major disadvantage with utilizing an opaque layer in an illuminated sign is that the sign in general becomes dull or dark and the colors become dim or mutated. For example, a color such as white actually appears to be gray and bright yellows become mustard toned. Conversely, utilizing multiple light translucent layers enables the sign in its entirety to be bright, yet have different dimensions, textures and light intensities depending on the number of translucent layers and their spatial relation to one another and the observer.

This novel invention provides a completely different effect than would be experienced were an opaque layer provided as claimed and taught by the prior art.

This invention also enhances visibility to the viewer by utilizing a halo effect around letters or indicia to be communicated. This halo effect is caused by light passing through multiple translucent layers of the sign and reflecting off of the rear face of a front layer, which comprises, for example, letters meant to be communicated to the viewer. The light subsequently reflects off of a foremost portion of a back layer, which is in the general shape of the front letter, then forward and outward around the edges of the front letter onward to the viewer. This creates a halo around that letter.

An outline effect is also created by light simply passing directly through the multiple translucent back layers and around the edges of a translucent front layer defining the letters, then passing directly onto the viewer.

Another benefit to this invention is the use of a solid milky white layer present across the entire rear face of the sign. This milky white layer not only diffuses light passing through it, increasing sign intensity and brightness, but also adds to the illusion of texture by not allowing the observer to see "through" the sign.

Another advantage to the use of a rear solid milky white layer is that several milky white layers may be placed adjacent the rear layer with the additional layer(s) having some element of design, meant to act as background in the sign for an added textured effect.

BRIEF SUMMARY OF THE INVENTION

This novel sign is comprised of multiple light translucent layers, tiered adjacent one over the next, with the very last layer furthest from the observer, being a translucent milky white diffusion layer. The letters or indicia of the sign to be communicated to the observer may be "cut-out" of one or more of the translucent layers. In other words, the integrity of the translucent layer(s) may be broken. Conversely, the letters may be printed directly on one of the translucent layers located near the front of the sign.

The multiple translucent layers primarily create the main background color(s) of the sign. The areas which define the letters preferably have a different color than that of the multiple translucent layers to provide contrast between the communication and the background.

There further exists a "void layer" between the multiple translucent layers, which create the background color of the sign, and a forefront layer(s) which is closest to the observer.

The void layer is preferably a completely clear, transparent layer. The greater 5 the width of this void, the more pronounced the depth of the sign and the greater the three-dimensional effect.

The forefront layer is in the shape of the letters or indicia to be communicated to the observer. If a three dimensional effect is desired, the letters are in general registered with the aforementioned letters printed or cut-out of the translucent layer(s) immediately adjacent the void layer. The forefront layer consists of a base color layer and an outer color layer. The base color layer is directly adjacent the void layer and is preferably reflective and can also be colored, and if desired, florescent.

The outer color layer directly adjacent the base color layer is on the very forefront of the sign and is closest to the observer. This outer color layer is opaque or translucent, preferably colored and if desired, florescent. This layer constitutes the main color of the letter or indicia to be communicated.

The sign also has a translucent milky white diffusion layer on the very rear of the sign. Additional milky white layers may be added to the sign if an added background effect is desired. This additional layer or layers should be between the rear solid milky white layer and the very last light translucent layer. The integrity of this additional milky white layer will be broken in areas in order to create a pattern or design.

All of the aforementioned create a sign with halo and outline effect, striking light intensities, brightness, three dimensional effect and texture.

DETAILED DESCRIPTION OF THE INVENTION

This novel sign is comprised of multiple light translucent layers, tiered adjacent to the next layer with the very last layer furthest from the observer being a milky white diffusion layer. The sign further consists of a forefront layer which defines the letters or indicia to be communicated. This forefront layer consists of an outer color layer and a base color layer. There also exists a void layer in between the forefront layer and the rear multiple translucent layers.

The sign of the present invention is manufactured from various films strategically placed in layers upon a substrate or void layer, so that the finished product can generally be described as a sign plate. The layers of film may consist of layers of pigment such as paint or ink, or layers of pressure sensitive vinyl (vinyl sheeting with an adhesive layer), or the like. The paints or inks are typically applied with an airbrush or silkscreen process, whereas the vinyl sheeting is typically cut with automated equipment controlled by a computer. Such processes of applying films to a sign plate substrate is well known in the art of sign making.

The sign of the present invention is illuminated from the rear of the sign. Typically, the sign is placed in a light box (not shown) such that the sign plate is framed by four sides of the box. Inside the box is at least one light bulb. Such light boxes are well known in the art of sign making.

Figure 1:
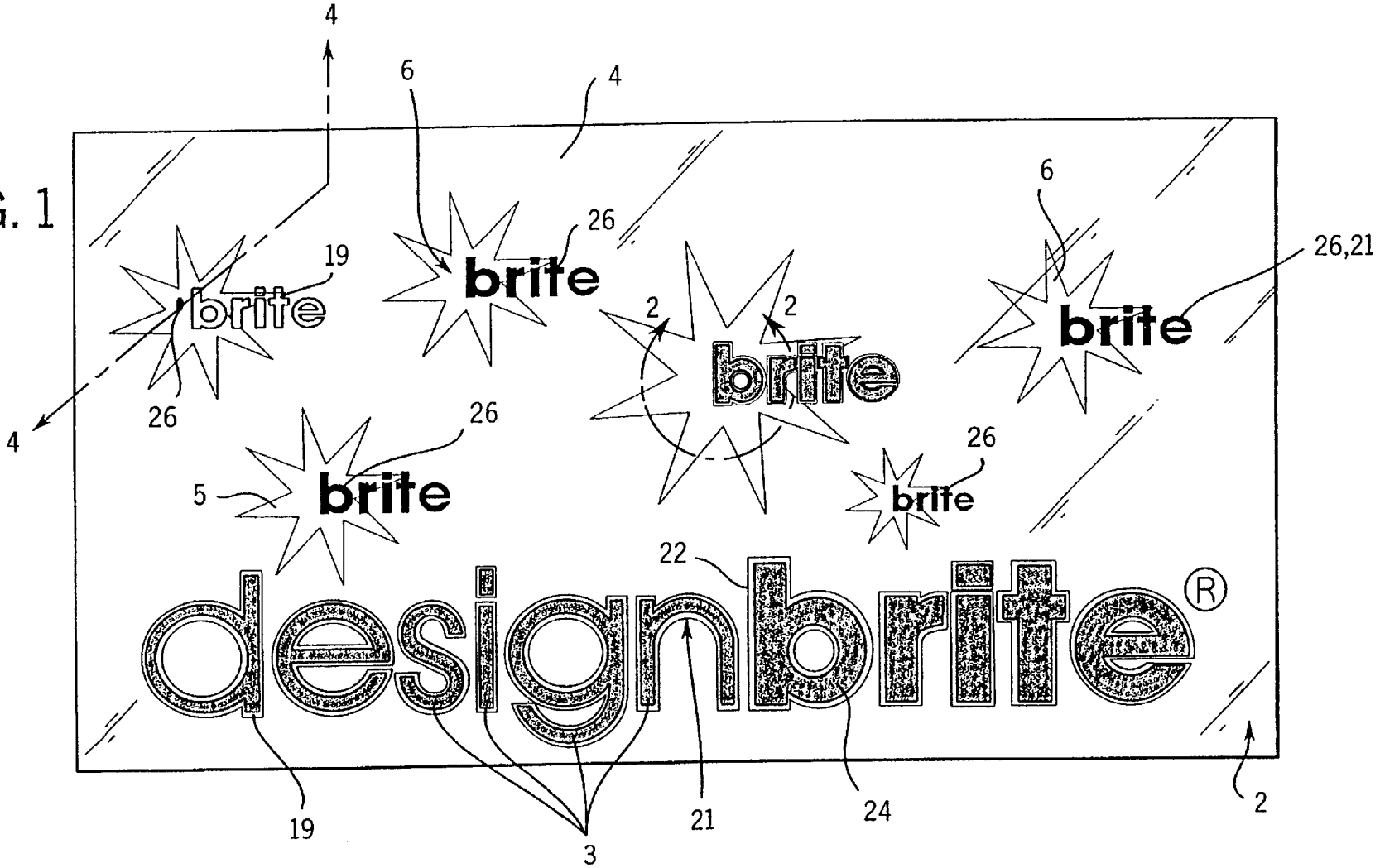
FIG. 1 is a front elevated view of the invention.

As seen in FIG. 1, the sign 2 has letters 3 or indicia on its front surface which are in general register with corresponding indicias or mid-layer 19 on one of the foremost light translucent layer surfaces 16, providing a three-dimensional effect. The color of this corresponding indicia on the light translucent mid-layer 19 will be the color of the outline around each letter once illuminated.

Figure 3:
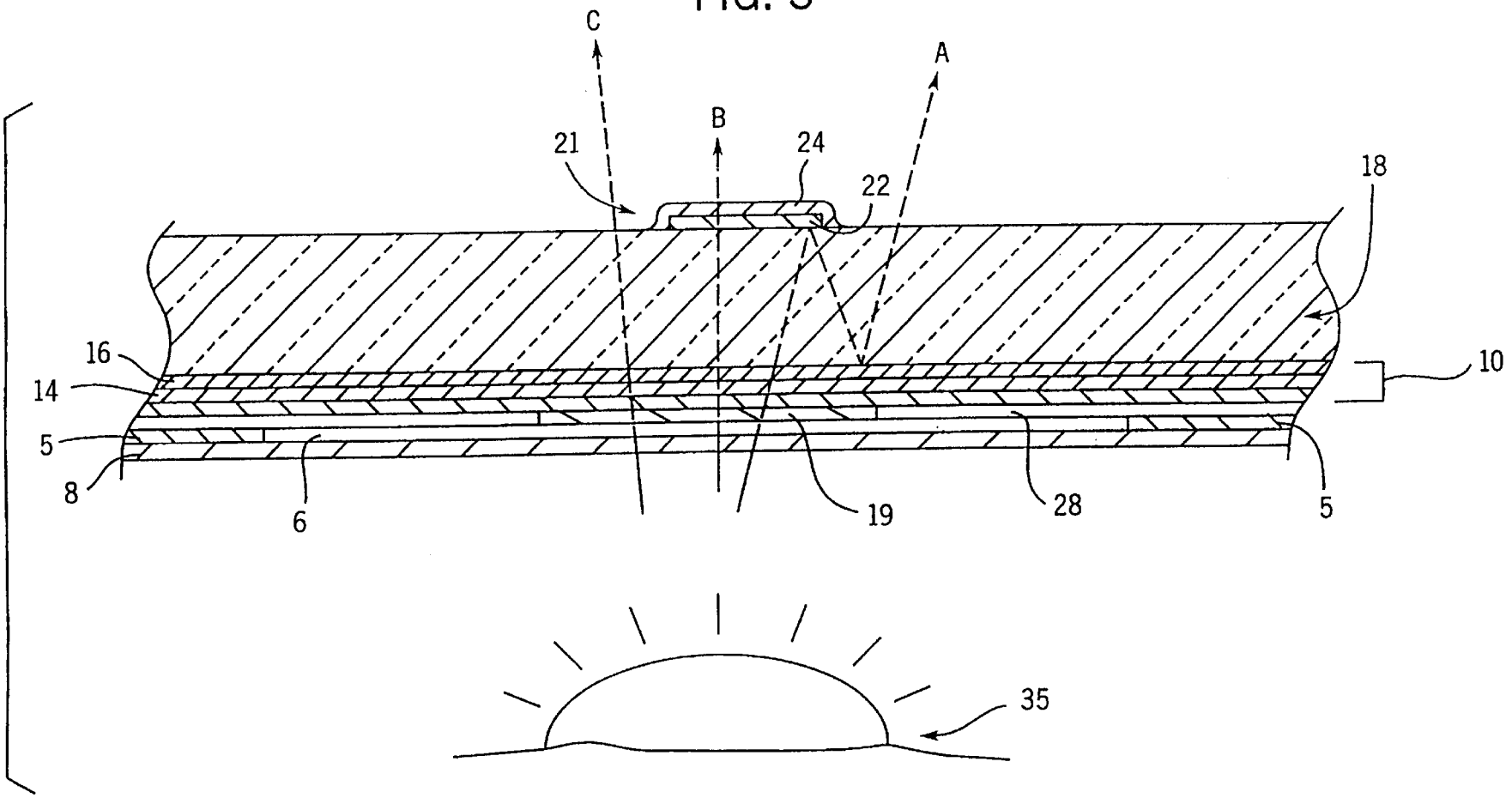
FIG. 3 is a cross-sectional view of the invention taken along lines 3—3 of FIG. 2.

As seen in FIG. 3, the area defining the letters 3 meant to be communicated to the observer, may be layered or printed directly on top of a transparent substrate plate called a "void layer" 18, as this substrate plate is void of any paints, designs, films or the like within the body of the substrate. Void area 18 aids in producing three dimensional effects to the sign.

Figure 2:
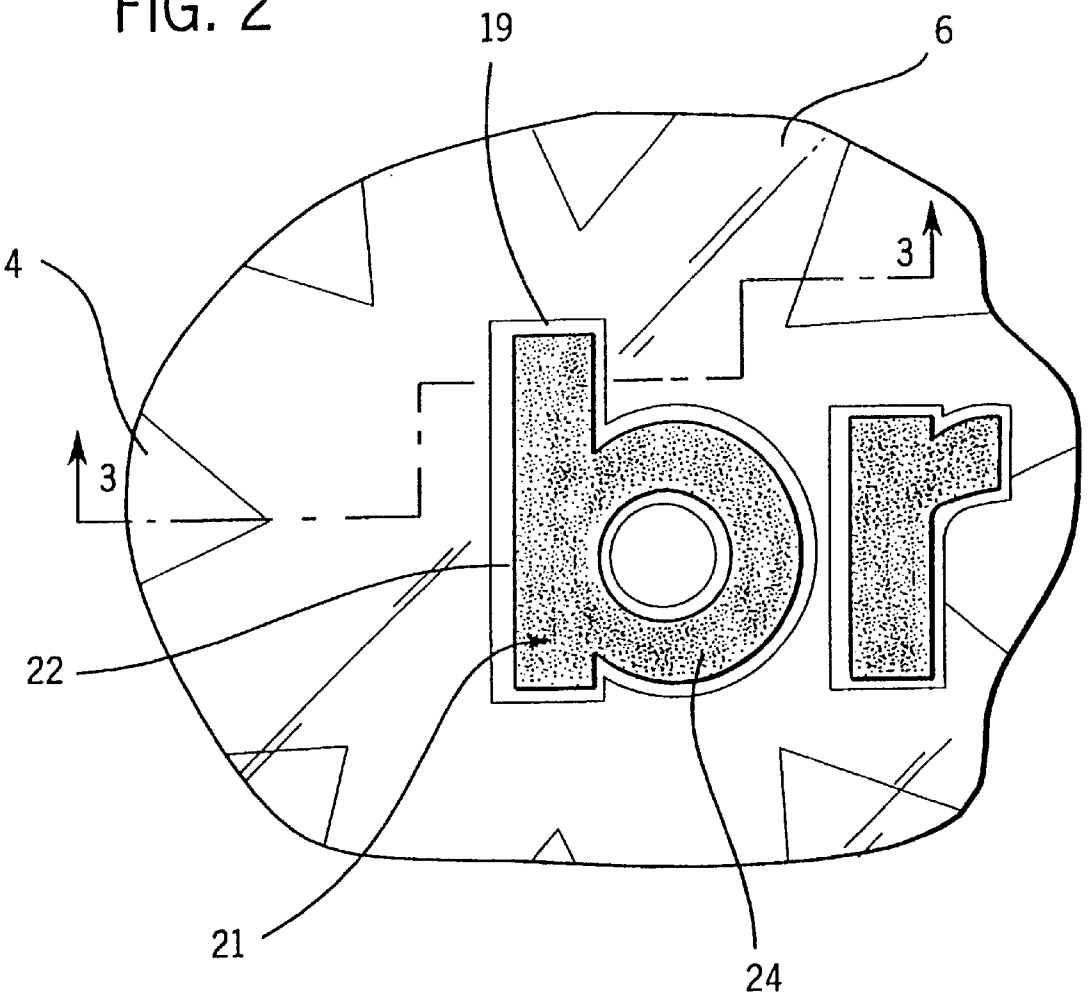
FIG. 2 is an enlarged view of a section 2—2 of the invention shown in FIG. 1.

As shown in FIGS. 2 and 3, the forefront layer 21 consists of two layers, one being the outer color layer 24, which is either opaque or translucent and is the basic color of the letters or indicia to be communicated. Preferably, underneath this outer color layer 24 and immediately adjacent the void layer 18, is a base color layer 22, having a back surface which is reflective. The degree of reflectivity is dependent upon the color of this base color layer 22. It is preferable that this base color layer 22 be white for a higher degree of reflectivity as this layer will affect the "halo" effect as described herein. The size of the base color layer 22 is always smaller than the outer color layer 24, otherwise the pattern created by such layers are substantially identical. In addition, the patterns should be aligned so that there is a uniform margin or border of outer color layer 24 around the base color layer 22. This prevents the viewer of the sign from seeing the underlying layer 22.

The intermediate area or void area 18 is between the forefront layer 21, defining the letters and including the outer color layer 24 and base color layer 22, and the rear multiple translucent layers 10. This void area 18 is preferably completely transparent, and comprised of a mat or glossy, clear and generally rigid plastics material such as acrylic or the like. The greater the thickness of the void area 18, the greater the three dimensional effect.

The entire background color 4 of the sign is determined by the color of the multiple light translucent layers 10. The intensity or brightness of the sign itself is determined by the actual number and vividness of light translucent layers 10, the intensity of the light source illuminating the sign, and the ambient light. FIG. 3 illustrates the multiple translucent layers 10 consisting of a first translucent layer 12, a second translucent layer 14 and a third translucent layer 16.

A mid-layer 19 coincides with the shape of the letters or indicia to be communicated if three dimensional, outline and halo effects are desired. This mid-layer 19 is colored and may even be florescent and it corresponds with the forefront layer 21, i.e. the area comprising the letters, indicia, etc. This mid-layer 19 may break the integrity of a forefront light translucent layer 16 or it may be printed or applied directly onto this light translucent layer 16.

The rearward most layer of sign 2 consists of a solid milky white light diffusion layer 8. There may be more than one milky white light diffusion layer if it is intended that a background design be created, best seen as the stars in FIG. 1. The design is created by breaks 6 in the integrity of the pressure sensitive vinyl, or continuity of the inks or paints making up the additional milky white layer 5, as shown in FIGS. 2 and 3. The breaks 6 create a desired pattern or shape i.e. letters, numbers, stripes, line drawings, or the stars as seen if FIG. 1.

The breaks 6 are highly exaggerated in the drawings for ease of explanation. However, it should known that there are no air gaps between the layers and the layers have direct contact with adjacent layers of material. If paints are used, there will be no air gaps as the paint will flow into such gaps. If pressure sensitive vinyls are used, there are no discernible gaps present even at the edge(s) 13, such edge shown in FIG. 3. When preparing a sign with layers of pressure sensitive vinyl, all air bubbles that may occur between layer must be pierced and the air removed as these bubbles would appear as undesirable spots.

If depth, outline and halo effects are not intended for certain indicia, then those indicia may be directly printed or applied onto any of the rear multiple light translucent layers, 12, 14 and 16 as demonstrated by a forward layer 26 and located between translucent layers 10 void layer 18 in FIG. 1. This would be intended for communications which are not meant to be a high priority, but are meant for added effect or secondary communication as these letters or indicia typically appear quite distant from the viewer, especially if they are smaller in size that the letters or indicia defined by forefront layer 21.

An outline effect also aids in creating a physical three-dimensional view. The outline effect is created by sizing the letters or indicia on the forefront layer 21 slightly smaller than the rear letters or indicia of the mid-layer 19.

If creation of a background design utilizing the translucent diffusion back layers is desired, an additional diffusion layer 5 is located adjacent the continuous diffusion layer 8 which comprises the entire rear-most surface of the sign. The diffusion layers are preferably free of color, and appear as a semi-transparent white layer. The additional diffusion layer 5 has breaks 6 in the form of the desired design, interrupting its continuity. These interruptions create the design once the sign is illuminated. Thus, where breaks 6 exist in the additional (i.e. closest to the viewer) diffusion layer 5, light passes through with a brighter intensity as opposed to the areas where there is no design, and light must pass through two diffusion layers 5 and 8.

Figure 4:
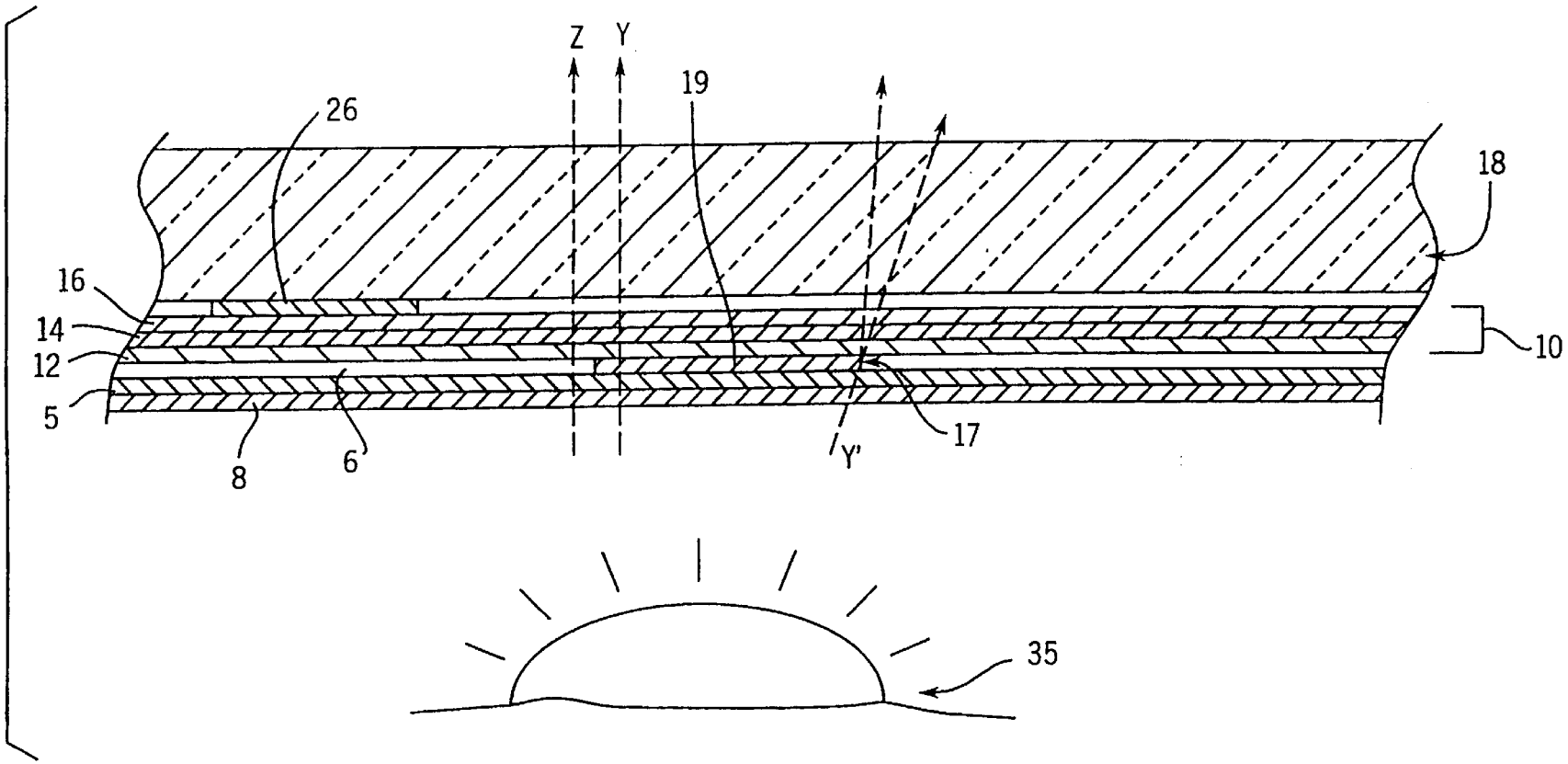
FIG. 4 is a cross-sectional view taken along lines 4—4 of FIG. 1.

An optional feature of this invention involves communications meant to be of less emphasis. These communications involve a complete lack of a forefront layer 21, as shown in FIG. 4. For example, some light is transmitted directly through the diffusion layers 5 and 8, through the multiple translucent layers 12, 14 and 16, and subsequently through void layer 18, as shown by light path Z. Other light rays additionally pass through mid-layer 19 as shown by light path Y. Yet other light rays are evident as a "halo" shown by light path Y'. The halo effect is greater when the void layer 18 has a mat surface, or refracts the light path. Materials such as optical quality glass would have no discernible halo effect when there is no forefront layer 21 present. Thus, due to the absence of a forefront layer 21, the light rays are not reflected and thus the halo effect is softer, if discernible at all. If forefront layer is present, as shown in FIG. 3, the halo effect is stronger due to the contrast of forefront layer 21 with the rest of the sign, and reflected light as shown by light path A in FIG. 3. (Of course, the example light rays shown in FIGS. 3 and 4 are simplistic in that there is some degree of reflection back into the plate. Most materials used to create the sigh do not transmit 100 percent of the light.)

The color of the halo is dependent on the color of the light transmitted through the mid-layer 19 and the color of the base color layer 22. For example, if the mid-layer 19 is white in color, and the base color layer 22 is yellow, the halo will appear yellow, assuming that the background color of layers 10 are also white. If the layers 10 were colored, then the halo would appear as a yellowish tinge on that particular background color.

In operation, light from the light source 35 is diffused by the rear-most milky white light diffusion layer 8. From there, light travels through multiple translucent layers 10. When light passes through a communication (i.e. letters, indicia, etc.), it passes through a translucent mid-layer 19, which is preferably colored, then it passes through a transparent void layer 18. Next, the light then may be reflected backward off of the base color layer 22, which is reflective, and which may have a color, but is preferably white. When the light rays are reflected off the base color layer 22, they pass back through the void layer 18 and strike the layers 10 (or the mid-layer 19) and diffusion layers 5 and 8, then pass through substrate 18 at an angle just past the letters (i.e. forefront layer 21) shown by light path A. (Again, the example is simplistic as not all light passes into the plate or reflected out, of the plate.) This in part creates the halo or glowing effect. If the forefront layer 21 is larger that the mid-layer 19, then the halo effect would be primarily created by light reflecting off the translucent layers 10 rather than mid-layer 19. If forefront layer 21 is translucent, then some light passes through this base color layer 22, and then travels directly through the outer color layer 24 onto the viewer, shown by light path B. The halo effect is diminished if the forefront layer is only slightly reflective, is highly translucent, or if its size is much larger than mid-layer 19. Further, if the pattern created by forefront layer 21 is very small, there is a diminished halo because there is a smaller reflective surface.

The design allows some light to pass directly through the diffusion layer 8, through through the mid-layer 19, through the multiple translucent layers 10 which consists of a first light translucent layer 12, a second light translucent layer 14 and a third light translucent layer 16, through the void layer 18 and onward just past the edges of the base color layer 22 and outer color layer 24 (i.e. the forefront layer 21), directly to the viewer to create somewhat of an outline effect, shown by light path C. The color of mid-layer 19 is the color of the outline, with the mid-layer 19 preferably being slightly wider than the forefront layer 21. As seen in FIGS. 3 and 4, the mid-layer 19 is located between the diffusion layer and aligned with a break 28 in the rear multiple translucent layers 10. Further, perfect registration of the mid-layer 19 and translucent layers 10 is very difficult to achieve. If registration is not perfect, a white gap or outline will be seen. To prevent the undesirable white outline, the mid-layer 19 must be slightly larger than the pattern created by break 28. However, if mid-layer 19 is too large, an undesirable shadow will be seen around the pattern.

Further, light can be transmitted directly through the diffusion layer 8, through the multiple layers of light translucent layers 10, which may or may not be colored, depending on the design of the sign, directly through the void layer 18 and onward to the viewer. Light which follows this path constitutes the main background color of the sign 4, as opposed to communicating the letters or indicia. If dark colors are used in the background, they are still translucent. For example, a dark grey pigment (95 percent black) is still translucent, but appears relatively black without the dulling effect of an opaque background.

In the case where a faint background design is desired, as shown by example in FIG. 1 as star shapes, light is transmitted through the first diffusion layer 8 and an additional diffusion layer 5 and onward toward to the viewer. Where there is a break 6 in the continuity of the additional diffusion layer 5, the light only passes through the diffusion layer 8 and onward toward the viewer which creates the background pattern or design in the additional diffusion layer 5. Where there is no break in the additional diffusion layer 5, light must travel through both layers, resulting in slightly less light intensity.

Since light is being transmitted through the sign in its entirety due to the complete lack of any opaque layers in the translucent layers 10 or diffusion layers 10, the sign itself is of great intensity and vibrant color.

I claim:

1. An illuminated sign plate having multiple translucent layers and having visual indicia to be communicated to a viewer, comprising:

a first translucent diffusion layer defining a back of the sign plate;

a translucent mid-layer adjacent the first diffusion layer, said mid-layer defining a pattern on the first diffusion layer;

at least two light translucent layers disposed on said first diffusion layer and said mid-layer defining a pattern, wherein a smaller, similar pattern is aligned with the pattern defined by the mid-layer;

a substantially transparent void layer having a first surface and a second surface, said void layer located adjacent to said mid-layer and translucent layers at the first surface; and at least one forefront layer disposed on the second surface of said void layer which corresponds and is aligned with said mid-layer, said forefront layer comprises a base color-layer and a corresponding outer color-layer; said outer color-layer being closest to a viewer of said sign and said base color-layer being adjacent to said void layer, and wherein said base-layer and said outer color-layer are in the shape of the indicia to be communicated to the viewer.

2. The illuminated sign plate of claim 1 wherein there exists a second diffusion layer located between said first diffusion layer and the light translucent layer.

3. The illuminated sign plate of claim 1 further including a forward layer defining a pattern, said forward layer located between the void layer and the translucent layer.

4. The illuminated sign plate of claim 1 wherein said mid-layer is colored.

5. The illuminated sign plate of claim 4 wherein the color of said translucent base-layer is white.

6. The illuminated sign plate of claim 1 wherein said forefront layer has a cross-section smaller than that of said mid-layer.

7. The illuminated sign plate of claim 1 wherein said forefront layer has a cross-section larger than that of said mid-layer.

8. An illuminated sign plate having multiple translucent layers and having visual indicia to be communicated to a viewer, comprising:

a first translucent diffusion layer defining a back of the sign plate;

a translucent mid-layer adjacent the first diffusion layer, said mid-layer defining a pattern on the first diffusion layer;

at least two light translucent layers disposed on said first diffusion layer and said mid-layer defining a pattern, wherein a smaller, similar pattern is aligned with the pattern defined by the mid-layer;

a substantially transparent void layer having a first surface and a second surface, said void layer located adjacent to said mid-layer and translucent layers at the first surface.

9. The illuminated sign plate of claim 8 wherein there exists a second diffusion layer located between said first diffusion layer and the light translucent layer.

10. The illuminated sign plate of claim 8 further including a forward layer defining a pattern, said forward layer located between the void layer and the translucent layer.

11. The illuminated sign plate of claim 8 wherein said mid-layer is colored.

12. The illuminated sign plate of claim 11 wherein the color of said translucent base-layer is white.

* * * * *